United States Patent [19]

Chiang

[11] Patent Number: 4,693,794

[45] Date of Patent: Sep. 15, 1987

[54] PROCESS FOR MANUFACTURING HYDROGEN PEROXIDE ELECTROLYTICALLY

[75] Inventor: John S. C. Chiang, Mercerville, N.J.

[73] Assignee: FMC Corporation, Philadelphia, Pa.

[21] Appl. No.: 932,833

[22] Filed: Nov. 20, 1986

[51] Int. Cl.[4] ..... C25B 1/30

[52] U.S. Cl. ..... 204/84; 423/220

[58] Field of Search ..... 204/83, 84; 423/220

[56] References Cited

U.S. PATENT DOCUMENTS

| | | | |
|---|---|---|---|
| 1,847,492 | 3/1932 | Nitzschke et al. | 204/84 |
| 3,454,477 | 7/1969 | Grangaard | 204/84 |
| 3,459,652 | 8/1969 | Grangaard | 204/294 |
| 3,462,351 | 8/1969 | Grangaard | 204/83 |
| 3,506,560 | 4/1970 | Grangaard | 204/263 |
| 3,507,769 | 4/1970 | Grangaard | 204/265 |
| 3,591,470 | 7/1971 | Grangaard | 204/84 |
| 3,856,640 | 12/1974 | Halfar et al. | 204/84 |
| 3,969,201 | 7/1976 | Oloman et al. | 204/83 |
| 4,118,305 | 10/1978 | Oloman et al. | 204/265 |
| 4,406,758 | 9/1983 | McIntyre et al. | 204/98 |
| 4,430,177 | 2/1984 | McIntyre et al. | 204/84 |
| 4,511,441 | 4/1985 | McIntyre et al. | 204/84 |

OTHER PUBLICATIONS

Balej et al., "Electrochemical Reactors", *Fortsch Verfarenstech*, 22(D), pp. 361–389 (1984).

*Primary Examiner*—T. Tung

*Attorney, Agent, or Firm*—Richard E. Elden; Robert L. Andersen; Eugene G. Seems

[57] ABSTRACT

The invention is a method for operating a cell or plurality of cells for manufacturing hydrogen peroxide by reducing oxygen contained in the air. The method comprises directing air free from carbon dioxide over a cathode surface comprising an exterior surface of the cell. The oxygen from the air diffuses into the porous cathode and is reduced to hydrogen peroxide at the surface of an alkaline electrolyte.

6 Claims, 1 Drawing Figure

PROCESS FOR MANUFACTURING HYDROGEN PEROXIDE ELECTROLYTICALLY

Figure 1:
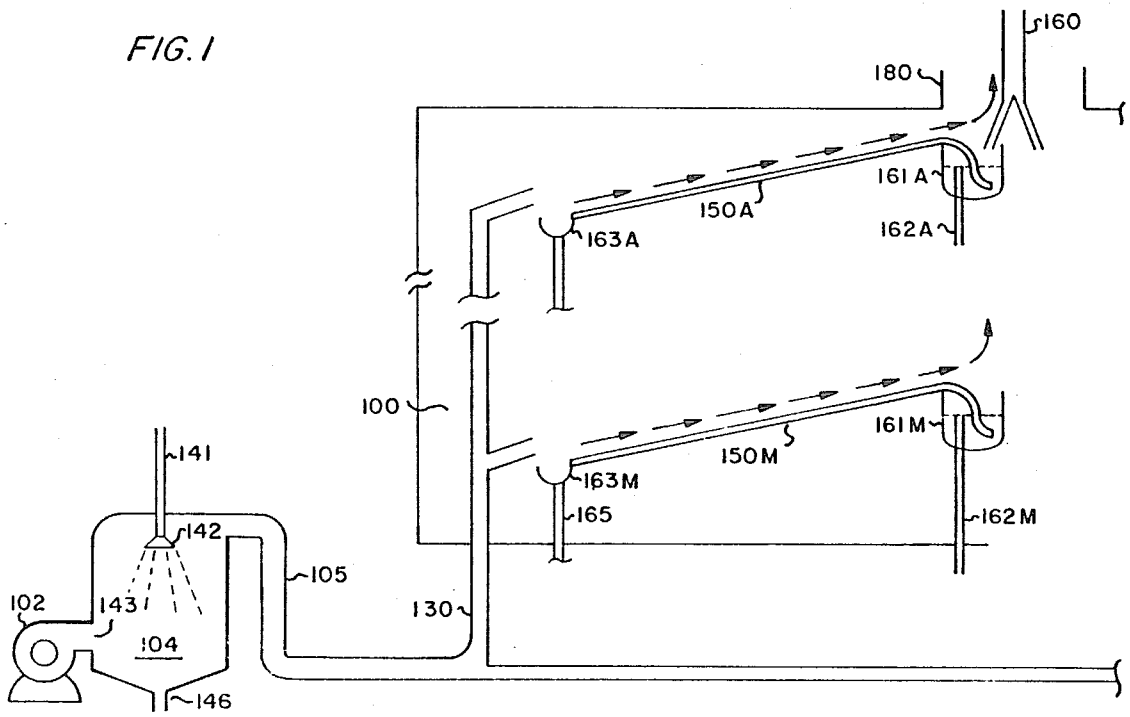

The present invention is a method for operating a cell or plurality of cells for manufacturing hydrogen peroxide by reducing oxygen contained in air.

For over a hundred years it has been known that oxygen can be reduced at a cathode to form hydrogen peroxide. In spite of the very low voltage for the half-cell reaction the process has never been commercialized.

U.S. Pat. Nos. 4,406,758 and 4,511,441 teach a method for operating an electrochemical cell employing a gas cathode. The electrolyte is introduced into the cell in the anode compartment where a gas such as oxygen is formed and exhausted from the cell. The electrolyte then passes through a separating means into a "trickle bed" or self-draining cathode. Oxygen gas is also introduced into the cathode and is reduced to form hydrogen peroxide. The hydrogen peroxide can optionally be decomposed or collected and employed as a bleach solution. Oxygen gas cannot be recycled to the cathode without separate collection and compression steps.

Both of these patents teach that the desired electrolytic reaction with gas will take place only where there is a three phase contact between a gas, an electrolyte solution and a solid electrical conductor. The patents teach that it is necessary to balance the hydraulic pressure of the electrolyte on the anode side of the separating means and on the cathode side of the separating means to maintain a controlled flow of electrolyte into the cathode and to maintain oxygen gas throughout the cathode. Pores of a sufficient size and number are provided in the cathode to allow both gas and liquid to flow simultaneously through the cathode.

The presence of oxygen is required at an oxygen cathode not only to maintain a high efficiency, but also to avoid a disastrous explosion. In the presence of an alkali metal hydroxide the oxygen cathode overall reaction is the reaction of oxygen and water to form hydroxyl ions and perhydroxyl ions (anions of hydrogen peroxide, a very weak acid). The cathode reaction is $$2O_2+2H_2O+4e^-\rightarrow 2HO_2^-+2OH^- \quad (1)$$

and the anode reaction is $$4OH^-\rightarrow O_2+2H_2O+4e^- \quad (2)$$

with an overall reaction of $$O_2+2OH^-\rightarrow 2HO_2^-. \quad (3)$$

In the absence of oxygen at the cathode that half cell reaction is $$2H_2O+4e^-\rightarrow H_2+2OH^-. \quad (4)$$

Undesirable side reactions can also take place at the cathode $$HO_2^-+H_2O+2e^-\rightarrow 3OH^- \quad (5)$$

and at the anode $$HO_2^-+OH^-\rightarrow O_2+H_2O+2e^- \quad (6)$$

Consequently, it is important to avoid a local high concentration of the perhydroxyl ion ($HO_2^-$) from accumulating in the catholyte.

Equation (4) can predominate if the cathode does not contain oxygen gas or hydrogen peroxide (equation 5) either because the cell is flooded with electrolyte, or because the supply of oxygen is inadequate. In the absence of oxygen at the cathode hydrogen gas will be formed. The hydrogen gas may form an explosive mixture with the oxygen gas in the oxygen supply manifold. In the alternative, if insufficient oxygen were introduced into the cathode, hydrogen would be formed in the oxygen-depleted section which would mix with oxygen in the oxygen-rich zone to form an explosive mixture.

In U.S. Pat. Nos. 3,454,477; 3,459,652; 3,462,351; 3,506,560; 3,507,769; 3,591,470, and 3,592,749 to Grangaard, the cathode is a porous plate with the electrolyte and oxygen delivered from opposite sides for reaction on the cathode. The porous gas diffusion electrode requires a wax coating to fix the reaction zone and careful balancing of oxygen and electrolyte pressure to keep the reaction zone on the surface of the porous plate. Oxygen generated at the anode of these cells also cannot be recycled to the cathode without expensive additional steps.

U.S. Pat. No. 4,118,305 to Oloman attempts to overcome the problems of balancing the hydrostatic forces to maintain a three phase system of a solid electrode (cathode), a liquid electrolyte and oxygen gas by continuously flowing a mixture of oxygen gas and a liquid electrolyte through a fluid permeable cathode, such as, a porous bed of graphite particles. A porous separator separates the packed bed electrode from the adjoining electrode and is supported by the packed bed electrode. The pores of the separator are sufficiently large to allow a controlled flow of electrolyte into the openings of the packed bed electrode. Electrochemical reactions occur within the electrode at a gas-electrolyte-electrode interface. The liquid products and unreacted electrolyte flow by gravity to the bottom of the packed bed electrode. Mass transfer is a problem in such cells because the electrode is almost flooded with electrolyte. Reactions are slow and recycle of product is necessary for acceptable product strength, and recycle of the excess oxygen gas is essential for economic operation. Further, the oxygen generated at the anode cannot easily be recycled to the cathode.

Each of these prior art electrolytic cells have a disadvantage of requiring a voltage substantially greater than the sum of the theoretical half cell voltages because of the high ohmic resistance of the cells which generates excessive heat and requires some cooling means. A further drawback to these cells is that they lack the means to vary the capacity of the cell during operation.

The limited solubility of oxygen in an alkaline electrolyte is a key problem in operating a safe and efficient hydrogen peroxide cell. The solubility of pure oxygen in 0.1 m NaOH is only 1.3 millimols/liter at 1 atmosphere. This concentration would limit a cell to a current density of about 0.001 A/cm$^2$, which is impractical. Attempts to overcome the solubility problem include employing superatmospheric oxygen pressure, trickle bed cathodes and the like. None of these attempts addressed the safety hazard that would exist if just one of the cells became deficient in oxygen.

Copending applications Ser. No. 932,836, filed Nov. 20, 1986; Ser. No. 932,834, filed Nov. 20, 1986; and Ser.

No. 932,832, filed Nov. 20, 1986 teach electrolytic cells having a cathode with a first surface contacting an electrolyte and a second surface comprising an exterior surface of the cell and in contact with air or another gas containing oxygen. A problem not recognized heretofore is that in continued operation a cathode reducing oxygen in the air to hydrogen peroxide gradually becomes inefficient and plugs up. It has been found that a cause of this problem is the presence of carbon dioxide in the air which is absorbed and forms crystals, either of a sodium carbonate or, in the presence of hydrogen peroxide, may form sodium carbonate peroxide crystals, any of which plug the pores of the cathode.

The present invention is a method for operating a cell or a plurality of cells, each cell having an electrolyte inlet, an electrolyte outlet, an anode, a porous cathode permeable to a gas, and separating means defining an anode compartment and a cathode compartment, said cathode having a first surface contacting the electrolyte and a second surface forming an exterior surface of the cell, the process comprising urging air into a container enclosing the cells or plurality of cells, removing carbon dioxide from the air, urging an alkaline electrolyte into the cell or plurality of cells, directing the carbon dioxide free air across the second surface of the cathode of the cell or plurality of cells to provide oxygen to the second surface of the cathode of the cell or cells, applying an electric potential between the anode and the cathode thereby reducing oxygen to hydrogen peroxide, exhausting air from the container, and collecting electrolyte containing hydrogen peroxide from the cell or cells.

The carbon dioxide may be removed from the air either before the air enters the container or after the air enters the container but prior to being directed across the second surface of the cathode of the cell or plurality of cells. The carbon dioxide may be removed by any convenient means, desirably by absorption by a solid or liquid. It is not necessary to remove all the carbon dioxide from the cell, but only a sufficient portion to prevent crystals from forming and plugging the cathode.

Absorption of carbon dioxide from the air by a liquid, for example, aqueous sodium hydroxide, is preferred because the relative humidity of the air can be adjusted simultaneously. One skilled in the art will readily recognize that this will provide a means to control the rate of evaporation of water from the electrolyte in the cathode compartment to prevent local over-concentration of the aqueous solution of sodium hydroxide and hydrogen peroxide in the electrolyte in the cathode compartment.

Surprisingly, it has been found that it is not necessary to direct the air in the container across the second surface of the cathode at a high velocity or to maintain air in the container at a superatmospheric pressure. A simple blower or fan is sufficient, thereby requiring a minimal amount of energy to be expended.

As a large volume of air can be moved easily the process has the added advantage of providing a simple means to exhaust excess heat generated in the cell with the exhausted air. One will readily recognize that a large number of cells operated in proximity to each other may require cooling even if the cells have a low ohmic resistance. As it is necessary to vent all the nitrogen in the air introduced into the container, this nitrogen, together with any oxygen therein, serves to remove heat generated by the cells as sensible heat. This permits closely packing many cells into a container.

It is necessary for safe operation that an excess of air be employed to ensure that sufficient oxygen is available to all the cells. It is desirable for a sufficiently large excess of air to be employed to maintain the temperature of the cells sufficiently low to prevent undue decomposition of the hydrogen peroxide. A temperature of less than 50° C. is desirable, and a temperature of less than 30° C. is preferable.

Another advantage of the present invention is that oxygen gas generated at the anode and exhausted from the anode compartment is available for reuse at a cathode of a cell without any separate collection and compression steps. Additionally, the present invention overcomes the safety hazards of the prior cells because each of the cells in the container has a cathode surface in contact with the air in the container so that the cells do not rely on separate means to deliver oxygen to each of the cells. The presence of oxygen at the cathode is necessary to avoid generating hydrogen in any one of the cells.

The following FIGURE illustrates one of the preferred embodiments of the invention in detail.

FIG. 1 is a cross sectional view of a container containing a plurality of cells having the second surface of the cathode forming the upper surface of the cell.

FIG. 1. Air is urged by blower 102, into spray scrubber 104 through air inlet 143 having spray inlet 141 directing aqueous sodium hydroxide from a source (not shown) to spray head 142. The air and spray of aqueous sodium hydroxide flow countercurrently through spray scrubber and the scrubbed air emerges into conduit 105. The aqueous sodium hydroxide flows from aqueous outlet 146 to a reservoir (not shown).

The air in conduit 105 which is free of carbon dioxide and the water content is in equilibrium with the aqueous sodium hydroxide solution and is introduced into container 100 through air distribution conduit 130. In container 100 are a plurality of cells 150A and 150M in a vertical stack connected to a source of direct current (not shown). The upper surface of each cell comprises a porous cathode. Aqueous sodium hydroxide electrolyte from storage reservoir (not shown) enters through electrolyte inlet 160 and is distributed into feed trough 161A having overflow conduit 162A. Electrolyte cascades from one feed trough to the one below and overflows from the container through 162M and is directed to a reservoir (not shown). Electrolyte is directed from a trough, such as, 161A into cell 150A. Air from manifold 130 is directed across the surface of cell 150A and diffuses into the cell where it is reduced to hydrogen peroxide. Electrolyte from cell 150A and 150M is collected in outlet troughs 163A and 163M. The outlet troughs are connected to outlet manifold 165 (illustrated only at cell 150M), and directing product to flow from the container to product storage tanks (not shown). Air is exhausted from container 100 through air exhaust outlet 180.

It is within the scope of the present invention that the container may contain only one cell or many cells. The cells may be arranged in one or several stacks, each stack consisting of a plurality of cells.

The best mode of practicing the present invention is exemplified by the following nonlimiting examples.

EXAMPLE 1, RUN A

A cell was set up in an enclosed container comprising a sheet of nickel as an anode forming the bottom of the cell. Layered on the sheet were a 0.1 mm thick first polyester felt serving as an anode compartment and a 0.025 mm thick water-wettable microporous polypropylene film employed as a separating means having 38% porosity with an effective pore size of 0.02$\mu$ meter. Slits were punctured through the film approximately 0.7 mm in length in a 1 cm×1 cm matrix. A second polyester felt serving as a cathode compartment was about 1 mm thick. Unless specified otherwise, the electrolyte in the reservoir was 4% NaOH containing 0.05% EDTA. In the Comparative Run A the cell was operated for 5 hours with a feed of 320 ml oxygen gas per minute at atmospheric pressure in contact with the second surface of the cathode. The cell was inclined at an angle of 10°.

The cathode was carbon black deposited on 1.25 mm thick 51 cm×15 cm graphite cloth impregnated with polytetrafluoroethylene (PTFE) and a mixture of carbon black and PTFE.

RUN B

Run B was similar to Run A except air was employed as the gas containing oxygen instead of pure oxygen at a rate of 1600 ml per minute.

RUN C

Run C also employed 1600 ml per minute of air as the gas containing oxygen and a cell angle of 12°. The cell employed a commercial ion exchange membrane punctured as above as a separating means. The carbon dioxide was removed from the air by contacting it with sodium hydroxide. The results are presented as Table I.

TABLE I

| Run | Time Hr. | % Effic. | % $H_2O_2$ | Flow g/m | °C. Feed | °C. Product |
|---|---|---|---|---|---|---|
| A | 1 | 96 | 1.7 | 9.1 | 24.4 | 26.3 |
| | 2 | 101 | 1.7 | 9.5 | 24.4 | 25.8 |
| | 3 | 92 | 1.6 | 9.2 | 24.5 | 25.7 |
| | 4 | 94 | 1.6 | 9.3 | 24.4 | 25.9 |
| | 5 | 87 | 1.5 | 9.5 | 24.4 | 25.7 |
| | Av. | 94 | 1.6 | 9.3 | 24.4 | 25.8 |
| B | 1 | 83 | 1.5 | 9.2 | 21.9 | 26.3 |
| | 2 | 88 | 1.4 | 10.0 | 23.1 | 27.1 |
| | 3 | 92 | 1.5 | 10.3 | 23.0 | 25.7 |
| | 4 | 97 | 1.5 | 10.4 | 23.6 | 25.4 |

TABLE I-continued

| Run | Time Hr. | % Effic. | % $H_2O_2$ | Flow g/m | °C. Feed | °C. Product |
|---|---|---|---|---|---|---|
| | 5 | 86 | 1.4 | 10.4 | 24.1 | 25.7 |
| | Av. | 89 | 1.45 | 10.1 | 23.4 | 26.0 |
| C | 1 | 76.4 | 1.1 | 11.0 | 24.0 | 27.1 |
| | 2 | 96.5 | 1.3 | 12.0 | 23.3 | 27.6 |
| | 3 | 92.0 | 1.2 | 12.2 | 22.5 | 26.1 |
| | 4 | 90.1 | 1.3 | 11.5 | 22.8 | 26.3 |
| | 5 | 85.6 | 1.3 | 10.9 | 22.6 | 26.3 |
| | Av. | 88.1 | 1.2 | 11.5 | 22.8 | 26.5 |

I claim:

1. Method for operating a cell or a plurality of cells, each cell having an electrolyte inlet, an electrolyte outlet, an anode, a porous cathode permeable to a gas, and separating means defining an anode compartment and a cathode compartment, said cathode having a first surface contacting the electrolyte and a second surface forming an exterior surface of the cell, the process comprising urging air into a container enclosing the cell or plurality of cells, removing carbon dioxide from the air, urging an alkaline electrolyte into the cell or plurality of cells, directing the carbon dioxide-free air across the second surface of the cathode of the cell or plurality of cells to provide oxygen to the second surface of the cell or cells, applying an electric potential between the anode and the cathode thereby reducing oxygen to hydrogen peroxide, exhausting air from the container, and collecting electrolyte containing hydrogen peroxide from the cell or cells.

2. The method of claim 1 wherein the carbon dioxide is removed from the air by contacting the air with aqueous sodium hydroxide.

3. The method of claim 1 wherein a sufficient excess air is supplied to maintain the temperature of the cell or plurality of cells less than 50° C.

4. The method of claim 1 wherein a sufficient excess air is supplied to maintain the temperature of the cell or plurality of cells less than 30° C.

5. The method of claim 2 wherein a sufficient excess air is supplied to maintain the temperature of the cell or plurality of cells less than 50° C.

6. The method of claim 2 wherein a sufficient excess air is supplied to maintain the temperature of the cell or plurality of cells less than 30° C.

* * * * *